US009440434B2

(12) United States Patent
Herrmann et al.

(10) Patent No.: US 9,440,434 B2
(45) Date of Patent: Sep. 13, 2016

(54) SYSTEM AND METHOD FOR USING INK DROP MODULATION TO COMPENSATE FOR MEDIA SURFACE HEIGHT VARIATIONS IN AN INKJET PRINTER

(71) Applicant: Xerox Corporation, Norwalk, CT (US)

(72) Inventors: Douglas K. Herrmann, Webster, NY (US); Jason M. LeFevre, Penfield, NY (US); Derek A. Bryl, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/497,959

(22) Filed: Sep. 26, 2014

(65) Prior Publication Data

US 2016/0089880 A1 Mar. 31, 2016

(51) Int. Cl.
*B41J 2/045* (2006.01)

(52) U.S. Cl.
CPC ..... *B41J 2/04558* (2013.01); *B41J 2/04586* (2013.01)

(58) Field of Classification Search
CPC ..... B41J 2/04558; B41J 2/04586
USPC ..... 347/6, 8, 19, 101
See application file for complete search history.

(56) References Cited

U.S. PATENT DOCUMENTS

| | | | | |
|---|---|---|---|---|
| 5,980,132 | A | 11/1999 | Kawai | |
| 7,445,302 | B2 | 11/2008 | Edwards et al. | |
| 8,226,194 | B1 * | 7/2012 | Bledsoe et al. | 347/14 |
| 8,493,628 | B2 | 7/2013 | Slaughter et al. | |
| 8,517,496 | B2 | 8/2013 | Sugimura et al. | |
| 2008/0145068 | A1 * | 6/2008 | Mizutani | B41J 29/38 399/12 |
| 2008/0238959 | A1 * | 10/2008 | Kato | B41J 11/007 347/8 |
| 2013/0076817 | A1 * | 3/2013 | Olson et al. | 347/12 |
| 2013/0293605 | A1 * | 11/2013 | Bar-Tal | B41J 2/04556 347/8 |

* cited by examiner

*Primary Examiner* — Jason Uhlenhake
(74) *Attorney, Agent, or Firm* — Maginot Moore & Beck LLP

(57) ABSTRACT

A printer attenuates banding visual defects arising from a lack of flatness in media as ink is ejected onto the media. The printer includes a detector that generates a signal corresponding to the slope in the media and a controller that modulates a volume of the ink drops ejected by one or more printheads in the vicinity of the slope in the media.

8 Claims, 6 Drawing Sheets

SYSTEM AND METHOD FOR USING INK DROP MODULATION TO COMPENSATE FOR MEDIA SURFACE HEIGHT VARIATIONS IN AN INKJET PRINTER

TECHNICAL FIELD

The device disclosed in this document relates to inkjet printers that eject ink directly onto media and, more particularly, to inkjet printers that eject aqueous ink.

BACKGROUND

In general, inkjet printing machines or printers include at least one printhead that ejects drops or jets of liquid ink onto a recording or image forming surface. In some inkjet printers, the printhead ejects ink directly onto the surface of media as the media passes the printhead. The media can be in the form of a continuous web or in the form of sheets. In continuous web printers, the media are pulled from a supply roll by actuator-driven rollers. As the web moves through the printer it passes around rollers to which tension is applied to keep the web taut as it passes through the printer to a take-up roll. In sheet printers, actuator-driven rollers are positioned against one another to form nips and these nips urge the sheets through the printer.

Image quality in an inkjet printer relies on the flatness of the media/substrate that receives the ink drops ejected by the inkjets in a printhead during the printing process. Currently, inkjet systems rely on mechanical devices to hold the media/substrate flat to ensure a uniform dot placement. In these systems, the printhead must rely on the paper handling capability of the mechanical system to maintain media/substrate flatness. In a continuous web printing system, movable rollers are operated to maintain tension in the web to help maintain flatness in the web as it passes the printheads in the printer. In cut sheet systems, vacuum platens or similar structures hold a sheet flat as the sheet passes one or more printheads. Despite these systems, the media/substrate presents, at least on occasion, an uneven surface profile to the printheads. For example, even if the substrate is held flat by tension or a vacuum, textured media presents uneven surfaces for printing. Unfortunately, these changes in the profile of the media/substrate from the side view lead to a sloped surface that affects dot to dot placement which is directly proportional to that slope.

For example, FIG. 5 shows a forty-two μm spacing between inkjets in a printhead and a media sheet as it passes the printhead. As shown in the figure, if the sheet is flat, the distance between two drops ejected by the two inkjets that fly straight to the media surface is the same as the separation between the two inkjets, namely, L1, which is forty two μm. If the media surface is curved, as shown in the figure, the distance is L2, which is L1/cos θ where θ is the angle of the slope in the media. This distance is larger than L1. Consequently, these drops are separated by a greater distance than drops ejected by the two inkjets where the media is kept relatively flat. This greater separation can be perceived by the human eye in some ink images and is known as banding. A printer that can compensate for sloped surfaces in media being printed would be beneficial.

SUMMARY

A printer that compensates for slope in media being printed has been developed. The printer includes a transport path configured to convey media through the printer in a process direction, at least one printhead positioned opposite the transport path, the at least one printhead being configured to eject drops of ink onto the media conveyed by the transport path past the at least one printhead in the process direction, a sensor positioned adjacent the transport path, the sensor being configured to generate a signal indicating a slope in the media being conveyed by the transport path before the media passes the at least one printhead, and a controller operatively connected to the at least one printhead and the sensor, the controller being configured to operate the at least one printhead to vary a volume of ink ejected by at least one inkjet in the at least one printhead with reference to the signal indicating the slope of the media.

A method of operating a printer helps compensate for slope in media being printed. The method includes conveying media along a transport path through the printer in a process direction, ejecting drops of ink from at least one printhead onto the media conveyed by the transport path past the at least one printhead in the process direction, generating a signal with a sensor that indicates a slope in the media being conveyed by the transport path before the media passes the at least one printhead, and operating with a controller the at least one printhead to vary a volume of ink ejected by at least one inkjet in the at least one printhead with reference to the signal from the sensor indicating the slope of the media.

BRIEF DESCRIPTION OF THE DRAWINGS

The foregoing aspects and other features of a printer that compensates for slope in media being printed are explained in the following description, taken in connection with the accompanying drawings.

DETAILED DESCRIPTION

Figure 1:
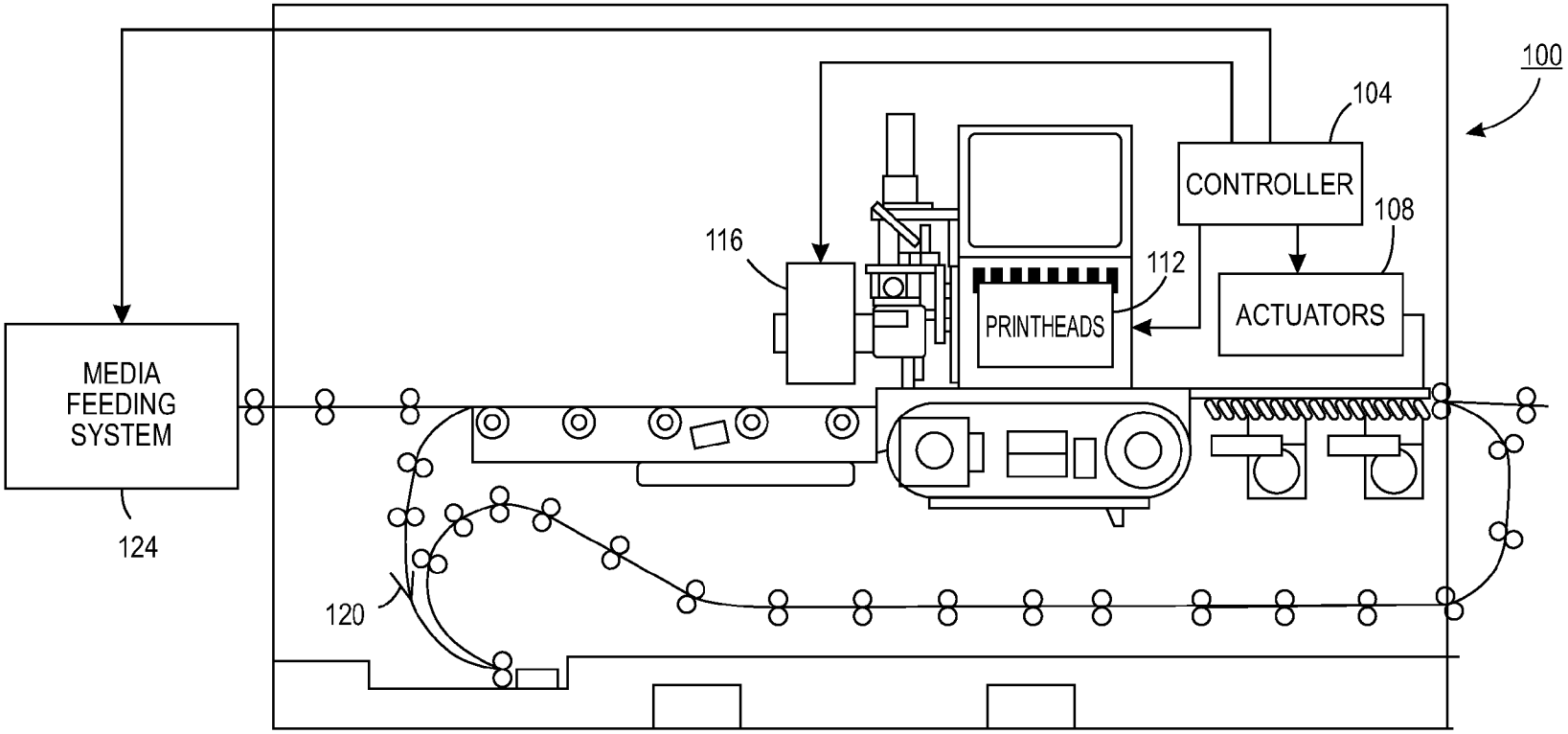
FIG. 1 is diagram of an inkjet printer that compensates for moisture in inks prior to media being printed.

For a general understanding of the environment for the device disclosed herein as well as the details for the device, reference is made to the drawings. In the drawings, like reference numerals designate like elements. As used herein, the terms "printer," "printing device," or "imaging device" generally refer to a device that produces an image on print media with liquid ink and may encompass any such apparatus, such as a digital copier, bookmaking machine, facsimile machine, multi-function machine, or the like, which generates printed images for any purpose. Image data generally include information in electronic form that a controller renders and uses to operate the inkjet ejectors in printheads in the printer to compensate for moisture in ink and to form an ink image on media sheets. These data can include text, graphics, pictures, and the like. The operation of producing images with colorants on print media, for example, graphics, text, photographs, and the like, is generally referred to herein as printing or marking. Aqueous inkjet printers are printers that use inks having a high percentage of water relative to the amount of colorant and/or solvent in the ink.

The term "printhead" as used herein refers to a component in the printer that is configured with inkjet ejectors to eject water-containing drops or ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in a solution, suspension or dispersion with a liquid solvent that includes water and/or one or more liquid solvents. The terms "liquid solvent" or more simply "solvent" are used broadly to include compounds that may dissolve colorants into a solution, or that may be a liquid that holds particles of colorant in a suspension or dispersion without dissolving the colorant.

FIG. 1 shows a configuration of an inkjet printer 100 that has been configured with a media slope detector that identifies slope in portions of media sheets passing through the printer before the printheads eject ink onto the media sheets. The controller then modulates the volume of the ink drops ejected by the printheads in the vicinity of the slope to compensate for the slope. The printer 100 includes a controller 104, one or more actuators 108, a printhead assembly 112, a media slope detecting subsystem 116, a transport subsystem 120 and a media feeding subsystem 124. The controller is operatively connected to the actuators 108, the printhead assembly 112, the media slope detecting subsystem 116, and the media feeding subsystem 124. The controller 104 is configured to receive image data from an image data source and generate firing signals for the operation of the printheads in the printhead assembly 120 for the formation of ink images on media sheets as the sheets pass by the printheads. The media sheets are stored in the media feeding subsystem 124 and the controller operates the media feeding subsystem to retrieve media sheets from the storage receptacle for the sheets and feed the sheets into the transport subsystem 120. The controller operates the actuators 108 to drive rollers within the transport system 120 to move the media sheets along a path in the transport subsystem that passes the sheets past the media slope detecting subsystem 116 and the printhead assembly 112. The sheets are then either ejected from the transport subsystem into a receptacle (not shown) for retrieval or they are diverted to the lower path of the transport subsystem. The lower path is configured for flipping the sheets over so the unprinted side of the sheets can be returned to the path past the media slope detecting subsystem and the printhead assembly before being directed into the receptacle for retrieval.

As used herein, the term "process direction" refers to movement along the path in the transport subsystem that moves the sheets past the media slope detecting subsystem 116 and the printhead assembly 112 and "cross-process direction" refers to a direction orthogonal to the process direction axis in the plane of the path past those two subsystems. To operate the inkjet ejectors in the printheads of the printhead assembly 112, the controller 104 receives a file of image data of an image to be produced on the media sheet. This image can include text alone, graphics alone, or a combination of text and graphics. These image data can be provided by a scanner or by an application program in a known manner. The controller 104 generates color separations and renders the color separations to produce halftone data. These halftone data can be provided to a processor in the printhead assembly 112 for the generation of firing signals or the controller can generate the firing signals and download them to a printhead controller in the assembly 112. The printhead assembly then operates the inkjet ejectors in the printheads of the printhead assembly 112 to eject ink drops onto the media sheet as the sheet passes the printheads to form an ink image on the sheet. Additionally, the controller 104 generates signals to operate one or more of the actuators 108 to coordinate the movement of media sheet and the operation of the inkjet ejectors in the printheads of the printhead assembly 112.

Figure 2:
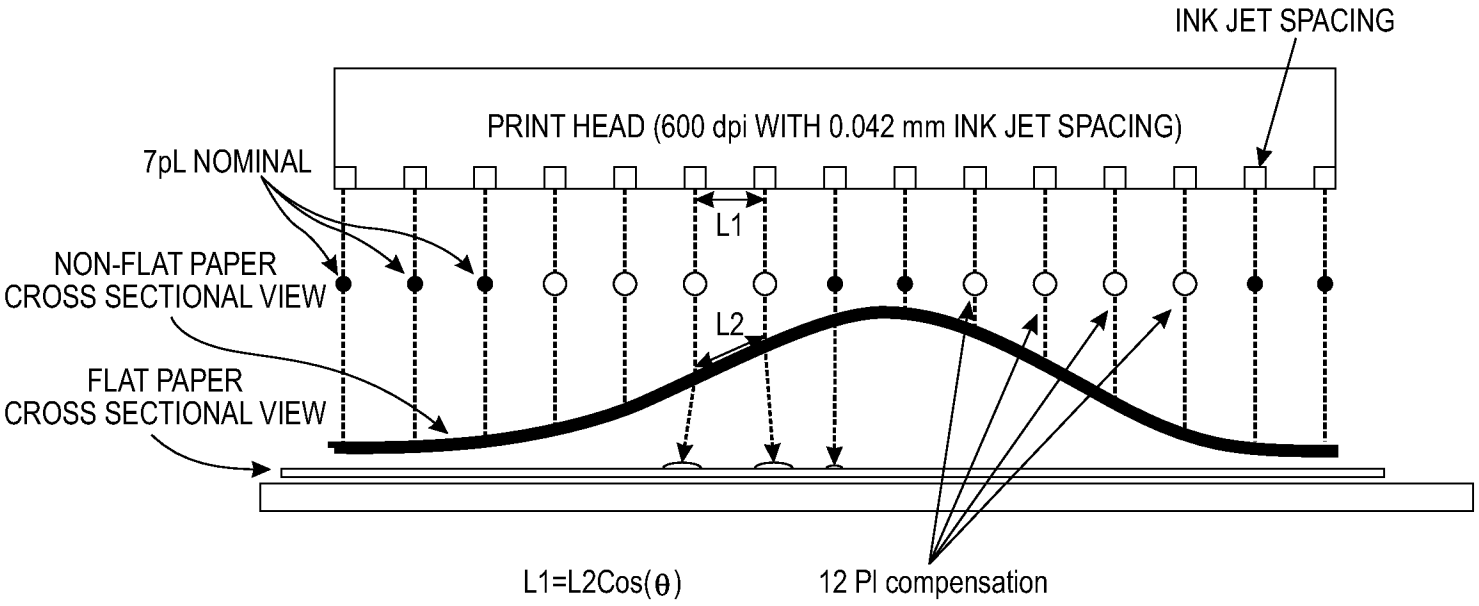
FIG. 2 is a diagram of modulated ink drops ejected by inkjets in the printer of FIG. 1 to compensate for slope in a media sheet.
Figure 3:
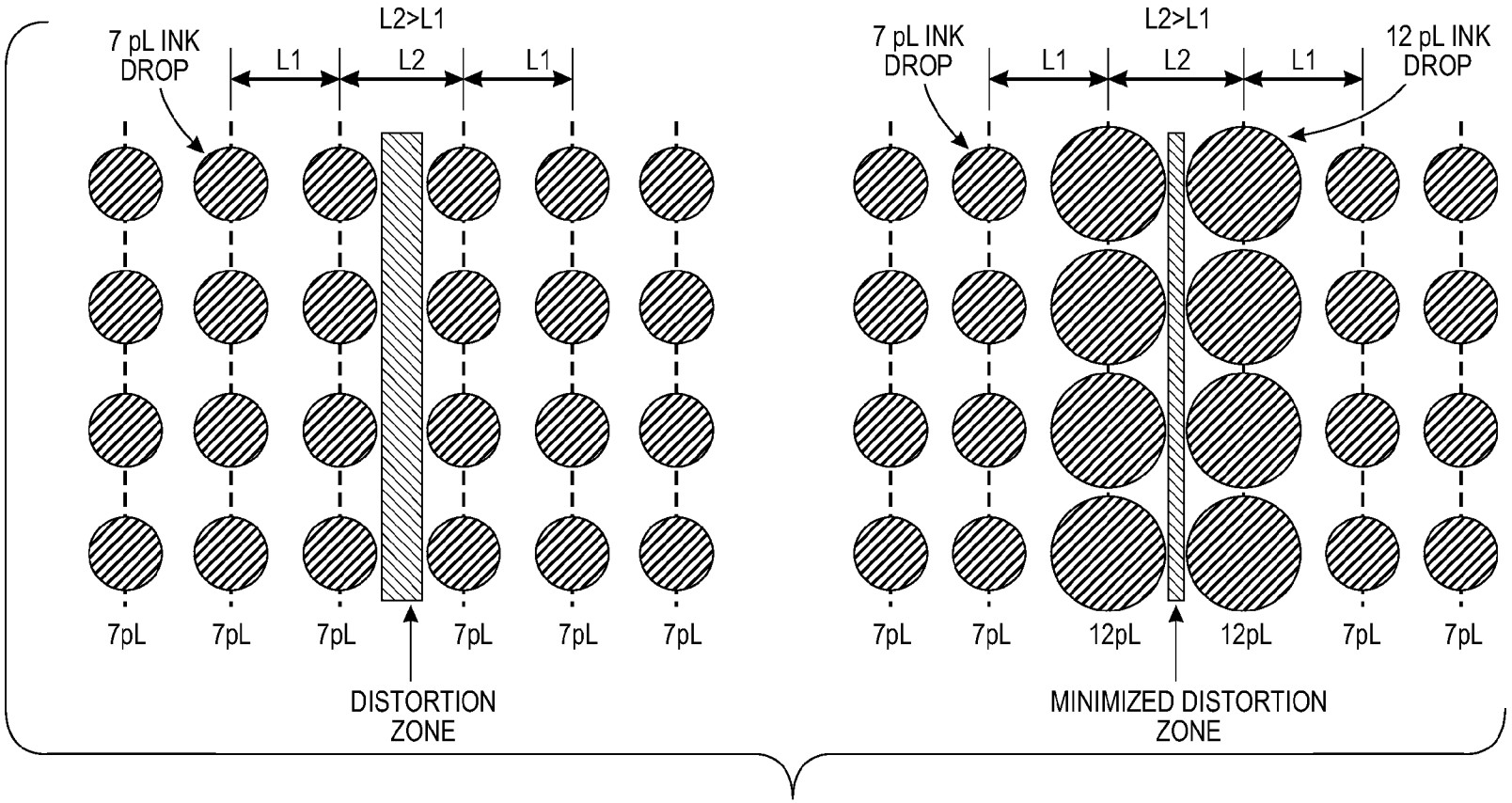
FIG. 3 is a diagram of a media sheet onto which modulated ink drops have been ejected to minimize the distortion area between columns of ink drops at a slope in the media sheet.
Figure 5:
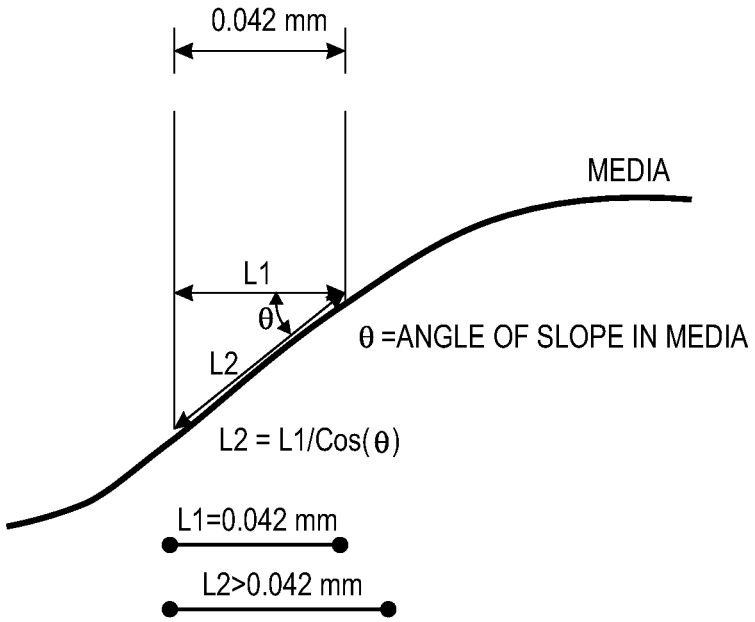
FIG. 5 is an illustration of the increased separation between ink drops caused by slope in media.

To explain the principles for addressing slope in media sheets with the media slope detecting subsystem 116, reference is made to FIG. 2. FIG. 2 depicts a media sheet 200 having a slope that is passing beneath a printhead 204. The sheet 200 is depicted as having a positive slope that leads to a peak in the media and then a negative slope to the transport path of the media sheet. As evident from the figure, the sheet 200 is relatively flat in the area preceding the positive slope, following the negative slope and at the peak. Consequently, these regions do not present the longer distance as noted above with the discussion of FIG. 5. On the slopes, however, the increased distance between drops of adjacent inkjets is present. By increasing the ink drop volume from the inkjets ejecting in the sloped areas, a wider line is formed and this wider line helps mask this increased distance between adjacent ink drops that would otherwise occur in the sloped areas. In the figure, the ink drop volumes in the relatively flat areas are 7 picoliters (pl), while the ink drop volumes in the sloped areas is 12 pl. These sizes are exemplary only and other drop volumes can be used depending on the printheads used and the degree of the slope detected. An illustration of the effect of the larger volume ink drops is shown in FIG. 3.

In one embodiment of the media slope detecting subsystem 116, a light source directs light across the surface of the media as the media passes the subsystem 116. Subsystem 116 also includes a light receiver positioned on a side of the media that is opposite the side on which the light source is positioned. Thus, the amount of light incident on the light receiver corresponds to the path across the media sheet. If the media slopes in the process direction, the raised portion diminishes the amount of light received at the receiver and the amplitude of the signal generated by the receiver is correspondingly reduced. Using empirical data, the amount of light received at the receiver can be correlated to media slopes and these data can be stored in a memory operatively connected to the controller 104 to enable the controller to compare the signals generated by the light receiver to these data and determine a slope of the media. In response to the media exceeding a minimal threshold, the controller modulates the driving signals to the inkjets in the printhead ejecting ink into the slope areas to increase the volume of the ink drops ejected into those areas. The amount of the volumetric increase in the ink drop volumes corresponding to the angle of the slope detected by subsystem 116. Printheads that can be operated to eject variable volumes of ink drops include the 300 dpi KJ4B printheads made by FUJIFILM Dimatix, Inc. of Santa Clara, Calif. and the 600 dpi printheads made by Kyocera of Kyoto, Japan. Alternatively, the media detecting system can include a mechanical arm that extends across the media sheet passing along the transport path that is raised by a slope surface as it contacts the arm. A transducer operatively connected to the arm generates an electrical signal corresponding to the distance the arm is raised and the controller can compare this signal to the data stored in a memory connected to the controller to determine an amount of slope in the media.

Figure 4:
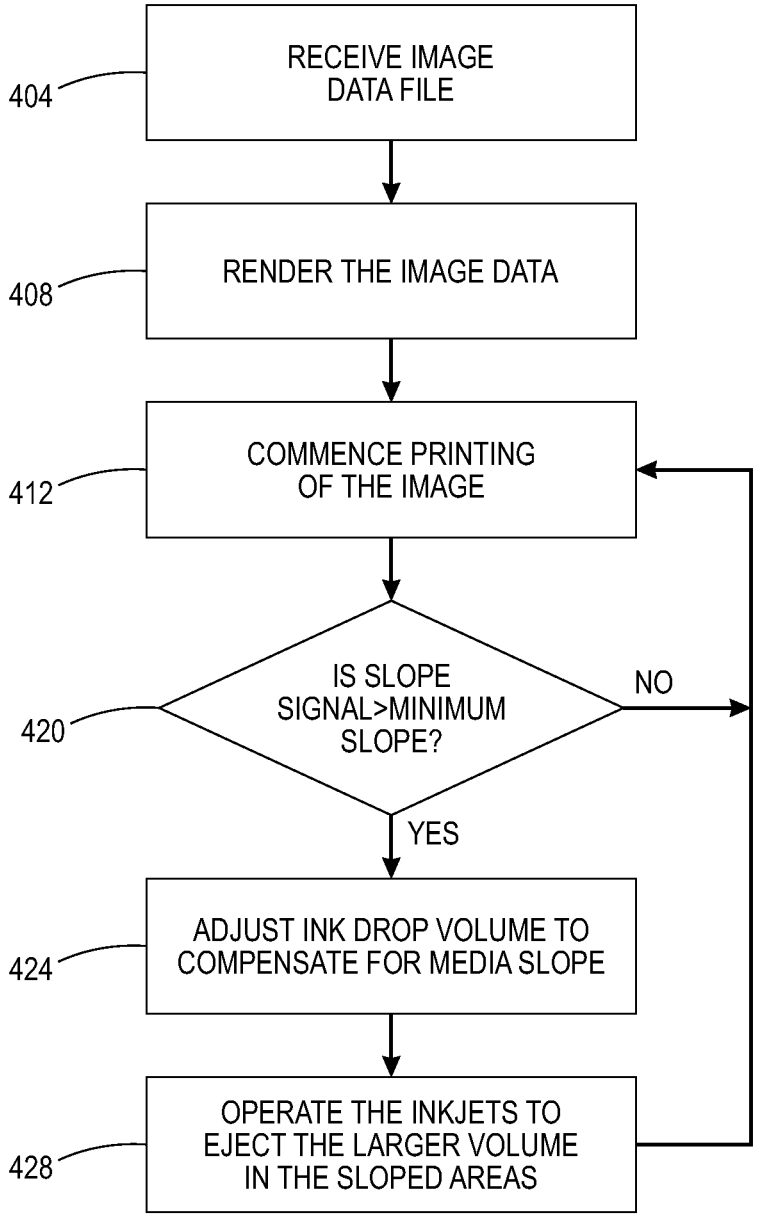
FIG. 4 is a flow diagram of a process for compensating for slope in media being printed.

A method of operating a printer that mitigates banding effects in ink images arising from a lack of flatness in media sheets is shown in FIG. 4. In the description of this method, statements that a process is performing some task or function refers to a controller or general purpose processor executing programmed instructions stored in a memory operatively connected to the controller or processor to manipulate data or to operate one or more components in the printer to perform the task or function. The controller 104 noted above can be such a controller or processor. Alternatively, this controller can be implemented with more than one processor and associated circuitry and components, each of which is configured to form one or more tasks or functions described herein.

At the beginning of a media sheet printing operation, the controller 104 receives a data file of image data for the image (block 404). The controller 104 generates color separation data and renders the data to produce halftone data that are used to operate the inkjets in the printheads (block 408). Printing the image corresponding to the rendered data then commences (block 412). As the media passes by the media slope detection subsystem 116, the controller receives a signal indicative of the slope of the media and compares the signal to a minimal slope threshold (block 420). If the controller determines an increase in ink drop volume is needed to compensate for the slope, the ink drop volume is adjusted (block 424). The controller then modifies the firing signal to the inkjets ejecting ink into the positively sloped and negatively sloped areas, while leaving the firing signals for the relatively flat areas alone (block 428). As the inkjets eject the higher volume ink drops in the sloped areas, the gaps between adjacent rows of ink drops is reduced and image quality is maintained.

Figure 6:
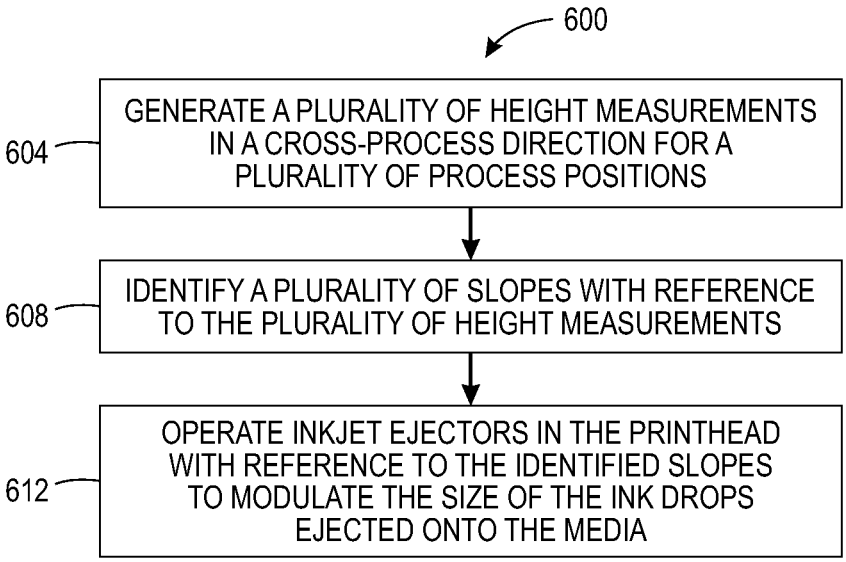
FIG. 6 is a flow diagram of a process for compensating for slope in a plurality of locations in a process and cross-process direction for media.
Figure 7:
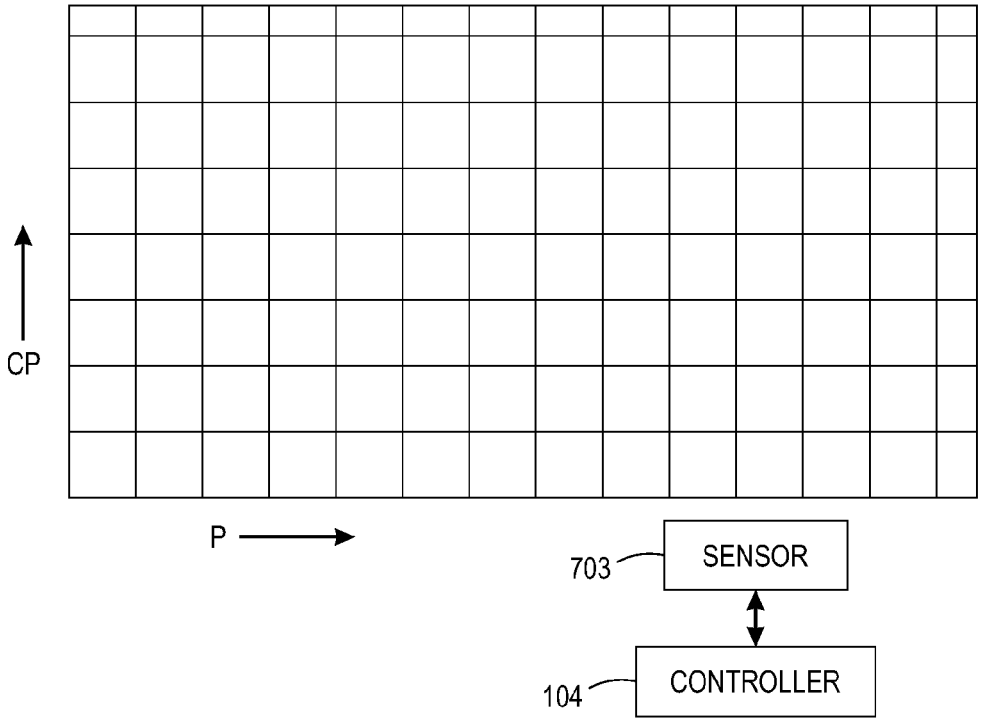
FIG. 7 is a depiction of a grid pattern in which a sensor and controller identify slope in a process and cross-process direction for media.

An alternative embodiment of the method for compensating for media slope in media is shown in FIG. 6. In this embodiment, an optical height measurement sensor, such as a blue laser sensor available from Keyence Corporation of America, Itasca, Ill. in the LJ-V7000 series of two dimensional and three-dimensional laser measurement systems. As shown in FIG. 7, the sensor 703 is positioned near the media path and the controller 104 operates the sensor to direct a laser towards a plurality of locations across the media as the media passes by the sensor. In the process 600, the sensor generates measurements of the distance between the media transport and the side of the media facing the printheads at a plurality of locations in the cross-process direction CP across the sheet for a plurality of positions in the process direction P as the sheet moves in the process direction past the printheads (block 604). Thus, a profile of the sheet is generated having a plurality of grids as shown in FIG. 7. Each grid can be uniquely identified with an index corresponding to the position of the grid in the process direction and an index corresponding to the position of the grid in the cross-process direction. The height measurements are provided to the controller 104 and the measurements for adjacent grids are evaluated to identify slope in both the process and cross-process directions (block 608). The controller generates firing signals to compensate for slope in both of these directions as the media passes the printheads (block 612).

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printer comprising:

a transport path configured to convey media through the printer in a process direction;

at least one printhead positioned opposite the transport path, the at least one printhead being configured with inkjets to eject drops of ink onto the media conveyed by the transport path past the at least one printhead in the process direction;

a sensor positioned adjacent the transport path, the sensor being configured to generate a signal indicating a slope in the media being conveyed by the transport path before the media passes the at least one printhead; and a controller operatively connected to the at least one printhead and the sensor, the controller being configured to modulate driving signals used to operate inkjets in the at least one printhead to:

operate the inkjets in the at least one printhead to eject a first volume onto the media by modulating the driving signals used to operate the inkjets in the at least one printhead in response to the signal from the sensor indicating the slope of the media is positive and less than a first threshold and the signal from the signal from the sensor indicating the slope of the media is negative and less than the first threshold; and operate the inkjets in the at least one printhead to eject ink drops having a second volume onto the media by modulating the driving signals used to operate the inkjets in the at least one printhead in response to the signal from the sensor indicating the slope of the media is positive and greater than a second threshold and the signal from the sensor indicating the slope of the media is negative and greater than the second threshold, the first threshold being less than the second threshold and the first volume being less than the second volume.

2. The printer of claim 1, the controller being further configured to modulate the driving signal for at least one inkjet in the at least one printhead to vary the volume of the at least one inkjet in the at least one printhead with reference to an angle of the slope indicated by the signal from the sensor.

3. The printer of claim 1, the sensor being further configured to generate height measurements for a plurality of locations in a cross-process direction across the media and for a plurality of portions of the media in the process direction; and the controller being further configured to identify slopes in the process direction and slopes in the cross-process direction and to modulate driving signals used to operate inkjets within the at least one printhead to vary a volume of ink ejected by adjacent inkjets in the cross-process direction across the at least one printhead with reference to the slopes identified in the cross-process direction and to modulate driving signals used to operate inkjet within the at least one printhead to vary a volume of ink ejected by adjacent inkjets in the process direction with reference to the slopes identified in the process direction.

4. The printer of claim 3 wherein the sensor is a blue laser sensor.

5. A method of operating a printer comprising:

conveying media along a transport path through the printer in a process direction;

ejecting drops of ink from at least one printhead onto the media conveyed by the transport path past the at least one printhead in the process direction;

generating a signal with a sensor that indicates a slope in the media being conveyed by the transport path before the media passes the at least one printhead; and modulating with a controller driving signals used to operate at least one inkjet in the at least one printhead to eject ink drops having a first volume onto the media in response to the signal from the sensor indicating the slope of the media is positive and less than a first threshold or the signal from the sensor indicating the slope of the media is negative and less than the first threshold; and modulating with the controller the driving signals used to operate the at least one inkjet in the at least one printhead to eject ink drops having a second volume onto the media in response to the signal from the sensor indicating the slope of the media is positive and greater than a second threshold or the signal from the sensor indicating the slope of the media is negative and greater than the second threshold, the first threshold being less than the second threshold and the first volume being less than the second volume.

6. The method of claim 5, the modulation of the driving signals for the at least one inkjet in the at least one printhead further comprising:

modulating the driving signals for the at least one inkjet to vary the volume of the ink drops ejected by the at least one inkjet in the at least one printhead with reference to an angle of the slope indicated by the signal from the sensor.

7. The method of claim 5, the signal generation further comprising:

generating height measurements for a plurality of locations in a cross-process direction across the media;

generating height measurements for a plurality of portions of the media in the process direction;

identifying slopes in the process direction and slopes in the cross-process direction; and modulating driving signals for the least one inkjet within the at least one printhead to vary a volume of ink ejected by adjacent inkjets in the cross-process direction across the at least one printhead with reference to the slopes identified in the cross-process direction and to vary a volume of ink ejected by adjacent inkjets in the process direction with reference to the slopes identified in the process direction.

8. The method of claim 7, the generation of the height measurements further comprising:

generating the height measurements with a blue laser sensor operatively connected to the controller; and identifying with the controller the slopes in the process direction and the slopes in the cross-process direction with reference to the height measurements generated by the blue light sensor.

* * * * *